United States Patent [19]

Griggs

[11] Patent Number: 5,001,855

[45] Date of Patent: Mar. 26, 1991

[54] ADJUSTABLE MOUNTING DEVICE FOR RECOIL ABSORBERS AND REDIRECT MECHANISMS

[76] Inventor: Jay P. Griggs, P.O. Box 789, Bountiful, Utah 84010

[21] Appl. No.: 941,148

[22] Filed: Dec. 12, 1986

[51] Int. Cl.[5] ..... F41C 23/06

[52] U.S. Cl. ..... 42/74

[58] Field of Search ..... 42/71.01, 72, 73, 74

[56] References Cited

U.S. PATENT DOCUMENTS

| | | | |
|---|---|---|---|
| 169,465 | 11/1875 | Miller | 42/74 |
| 1,088,362 | 2/1914 | Perkins | 42/73 |
| 1,468,354 | 9/1923 | Caretto | 42/73 |
| 1,480,350 | 1/1924 | Martin | 42/74 |
| 2,453,394 | 11/1948 | Whittman | 42/73 |
| 2,787,855 | 4/1957 | Guymon | 42/73 |
| 3,207,496 | 9/1965 | Hrebicek | 267/1 |
| 3,388,494 | 6/1968 | Kimball | 42/74 |
| 3,754,344 | 8/1973 | Spilleta | 42/74 |
| 4,316,342 | 2/1982 | Griggs | 42/74 |

FOREIGN PATENT DOCUMENTS

| | | | |
|---|---|---|---|
| 63761 | 8/1892 | Fed. Rep. of Germany | 42/73 |

*Primary Examiner*—Charles T. Jordan

*Attorney, Agent, or Firm*—Warren F. B. Lindsley

[57] ABSTRACT

A device for adjustably mounting a recoil absorber on the butt stock end of a gun so that the recoil absorber can be adjustably moved up and down, crosswise, rotationally or at an angle on the stock or readily transferred to another stock with ease and in a short period of time.

1 Claim, 3 Drawing Sheets

FIG. 10
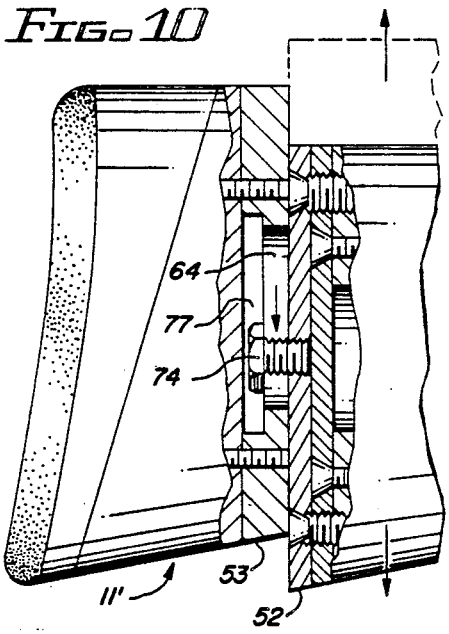
FIG. 11
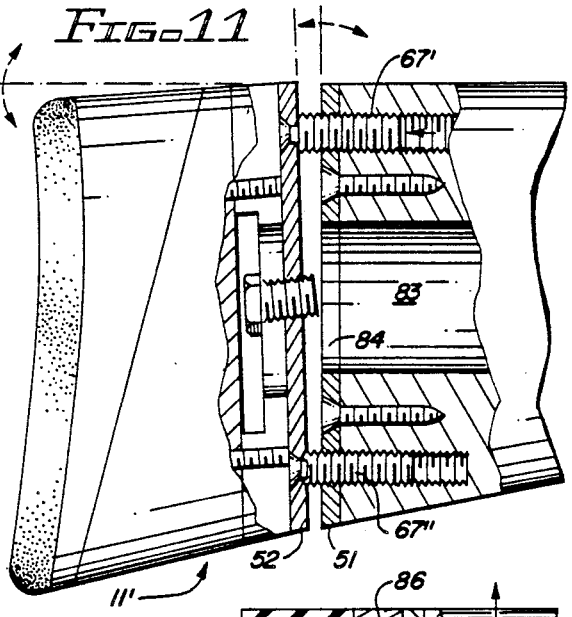
FIG. 13
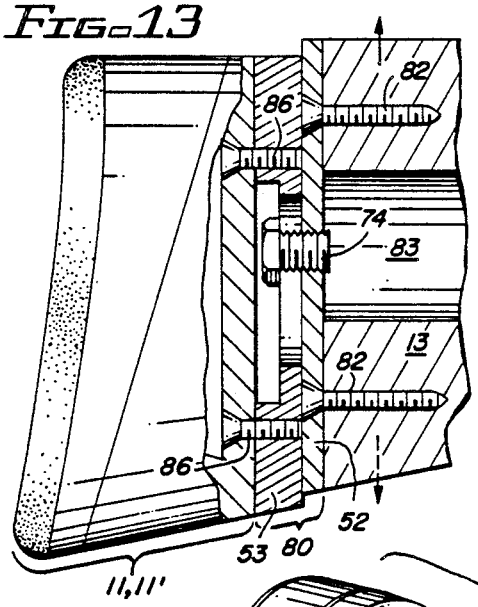
FIG. 14
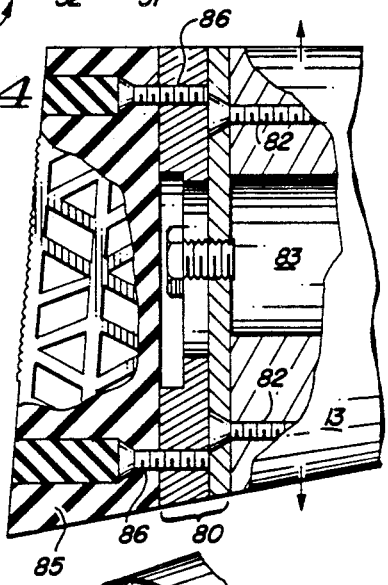
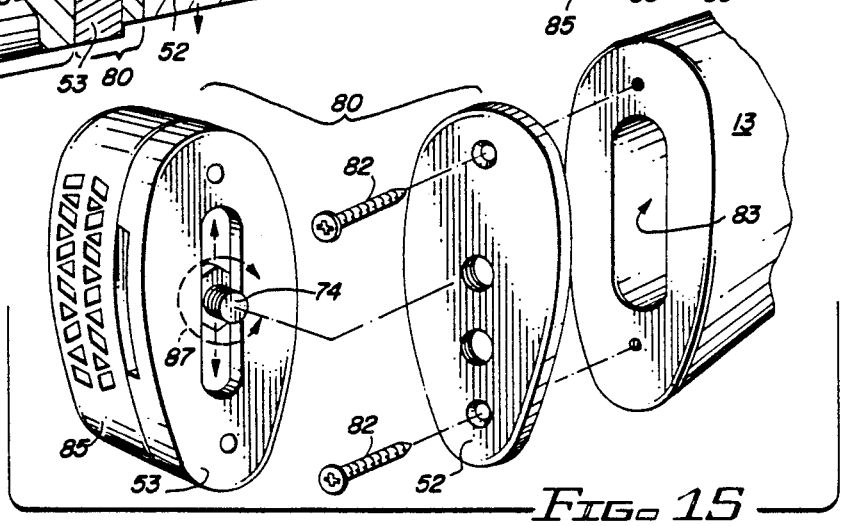
FIG. 15

ADJUSTABLE MOUNTING DEVICE FOR RECOIL ABSORBERS AND REDIRECT MECHANISMS

BACKGROUND OF THE INVENTION

This invention relates to recoil absorbers and redirector mechanisms for shoulder supported firearms such as rifles and shotguns, and more particularly, to a device for adjustably mounting the recoil absorbers and redirectors on the butt stock of a gun so that it can be adjustably moved up and down, crosswise or at an angle on the butt stock, or readily transferred to another stock with ease in a short period of time.

Heretofore, recoil absorbers and redirector mechanisms, when mounted on a gun stock for reducing and redirecting recoil energy, were relatively fixed and could not be adjusted to more closely fit the contour of the shoulder and the particular needs of the user.

DESCRIPTION OF THE PRIOR ART

Although the prior art has attempted to reduce recoil of shoulder supported firearms with various gun stock mounted devices, none have employed in combination with them a means for adjustably mounting the recoil mechanisms to fit the needs of the users.

U.S. Pat. No. 169,465 discloses a recoil check for gun stocks employing a hinge guided, spring actuated check plate.

U.S. Pat. No. 1,088,362 discloses an adjustable butt plate for gun stocks, the plate of which is positioned relative to the gun stock for a given user of the firearm and then fixedly bolted in position.

U.S. Pat. Nos. 1,468,354 and 2,453,394 provide recoil absorbers capable of universal movement between the shoulder engaging portion and the gun stock.

U.S. Pat. No. 1,480,350 discloses a gun employing a shoulder pad which is pivoted thereto on a transverse pivot located back of the stock of the gun with means disposed on opposite sides of the pivot for adjusting the pad with respect to the stock and retaining the pad in the adjusted position.

U.S. Pat. No. 2,787,855 discloses an adjustable butt plate which may be displaced vertically and bolted in that position.

U.S. Pat. No. 3,207,496 discloses a recoil mechanism employing a variable rate spring mechanism and associated cams providing reciprocable action between the relatively movable parts of a gun stock mechanism.

U.S. Pat. No. 3,388,494 discloses a gun stock comprising two pivotal sections which respond by pivotal action to the recoil of a shot.

U.S. Pat. No. 3,754,344 discloses a gun recoil absorber employing spring tensioned lever actuated means anchored within a cavity in the gun stock. The mechanism is adapted to reciprocate in an axial direction and is operatively associated with a hollow movable end member conforming to the shape and dimensions of an adjacent conventional wooden gun stock.

U.S. Pat. No. 4,316,342 discloses a recoil absorber and redirector mechanism for a shoulder held gun stock which reduces the effects of recoil by causing one of two normally aligned members mounted on the butt end of a gun stock to move laterally of the other under recoil, thereby redirecting the forces of recoil with the movable member resiliently absorbing most of the recoil energy which is later used to reset the mechanism to its normal inactive position.

SUMMARY OF THE INVENTION

In accordance with the invention claimed, an adjustable mounting device is provided for securing a recoil absorber to the butt end of a gun stock and for adjustably moving the recoil absorber relative to the butt of the gun in a number of positions relative to the butt stock for the convenience of the user.

It is, therefore, one object of this invention to provide an improved mounting device for the end of a gun stock of a shoulder held firearm which mounts a recoil absorber and which is adjustable for moving the recoil absorber relative to the end of the gun stock.

Another object of this invention is to provide a new and improved mounting device for the end of the butt stock of a shoulder mounted gun for adjustably mounting a recoil absorber, which device may be adjusted for movement of the absorber laterally of or angularly of the end of the butt stock.

A further object of this invention is to provide a gun stock butt end mounting device for adjustably positioning a recoil absorber which may be economically manufactured and readily assembled on the butt end of a gun stock with most, if not all, presently sold recoil absorbers.

Other objects and features of the invention relating to details of construction and operation will be apparent in the following description and claims.

BRIEF DESCRIPTION OF THE DRAWINGS

The present invention may be more readily described by reference to the accompanying drawings, in which:

FIG. 10 is a partially cut away side view of the mechanism and mounting device of FIGS. 1, 5 and 6 with the mounting device adjusted to displace the mechanism laterally in an upward direction;

FIG. 11 is a partially cut away side view of the mechanism and mounting device of FIGS. 1, 5 and 6 with the mounting device adjusted to displace the mechanism angularly relative to the gun stock;

FIG. 13 is a partially cut away side view of the recoil mechanism and a simplification of the mounting device of FIGS. 1, 5 and 6 with the mounting device adjusted to displace the mechanism laterally in a downward direction;

FIG. 14 is a partially cut away side view showing the simplified mounting device employed to secure a simple recoil absorbing pad to the stock of a gun; and FIG. 15 is an exploded perspective view of the simplified mounting device and pad assembly of FIG. 14.

DESCRIPTION OF THE PREFERRED EMBODIMENT

Figure 1:
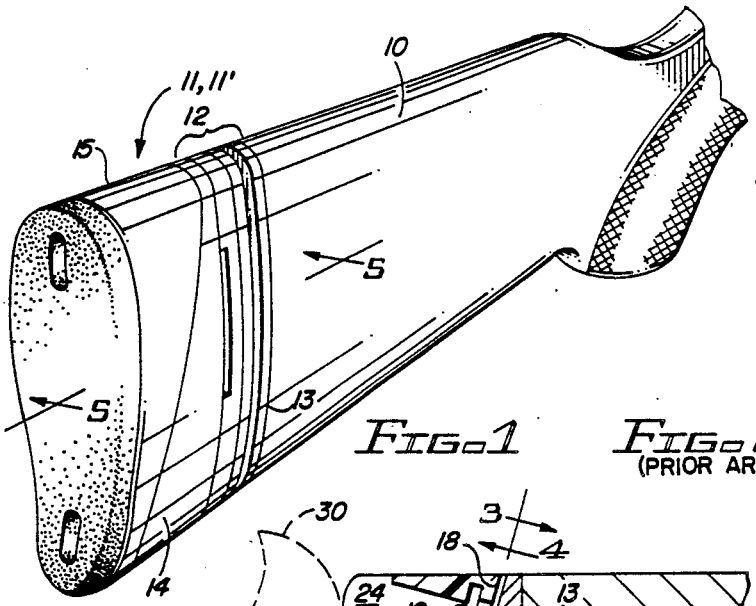
FIG. 1 is a partial perspective view of the gun stock end of a shoulder held gun or firearm showing a recoil absorber and redirector mechanism secured thereto by the adjustable mounting device of the invention.

Referring more particularly to the drawings by characters of reference, FIG. 1 discloses the stock 10 of a standard rifle or shotgun with the usual barrel, magazine and trigger not shown for simplicity purposes. The details of operation of the gun are not essential to the description of the particular invention but, in general, the firearm or gun may be a single shot or a rapid firing, relatively high powered firearm. In the design shown, the stock of the gun may be formed of a molded plastic, although it can be formed of any other suitable material such as solid wood.

A recoil absorber mechanism 11 is attached to the butt of a gun stock 10 using an adjustable mounting device 12 embodying the invention. Although any absorber pad or recoil mechanism may be used with the mounting device claimed, and fall within the scope of this invention, for purposes of illustration recoil mechanism 11 may comprise two relatively movable members 14 and 15 constructed and connected so that one member may move laterally of the other under the forces of recoil.

Member 14 comprises a base plate 16 which is secured to a butt end 13 of gun stock 10 by means of adjustable mounting device 12 which can be moved up or down, rotationally, or at a canted angle with respect to the butt end of the gun stock.

Figure 3:
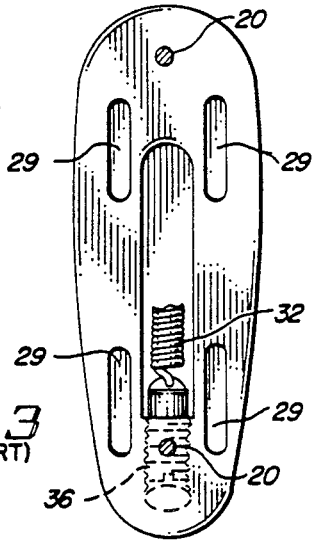
FIG. 3 (PRIOR ART)
FIG. 3 is a cross-sectional view of the mechanism of FIG. 2 as seen along line 3—3 of FIG. 2.
Figure 2:
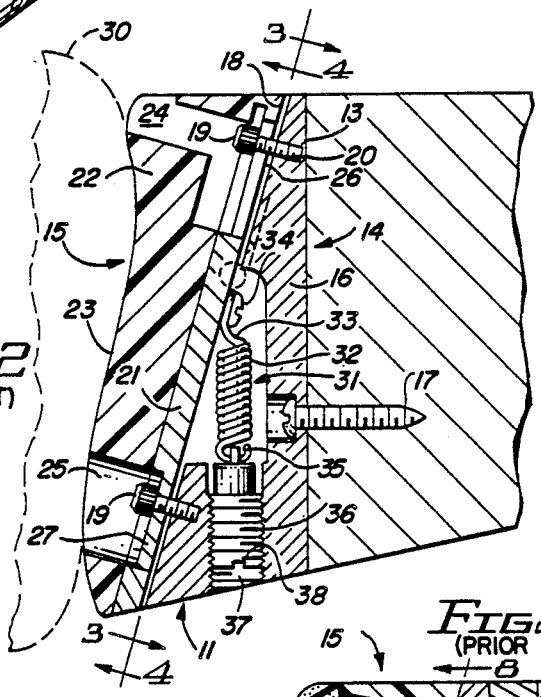
FIG. 2 (PRIOR ART)
FIG. 2 is a cross-sectional view of a recoil absorber and redirector mechanism showing the prior art method of mounting the mechanism directly to the end of the gun stock.
Figure 4:
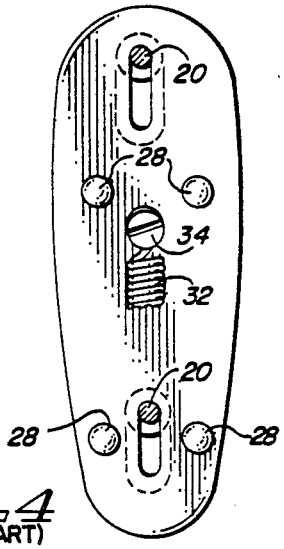
FIG. 4 (PRIOR ART)
FIG. 4 is a cross-sectional view of the mechanism of FIG. 2 as seen along line 4—4 of FIG. 2.
Figure 8:
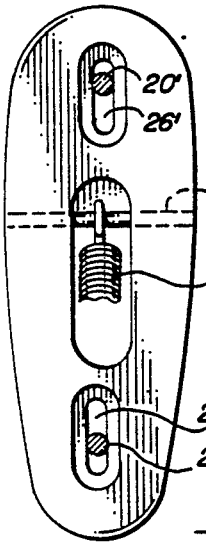
FIG. 8 is a cross-sectional view taken along line 8—8 of FIG. 5.
Figure 5:
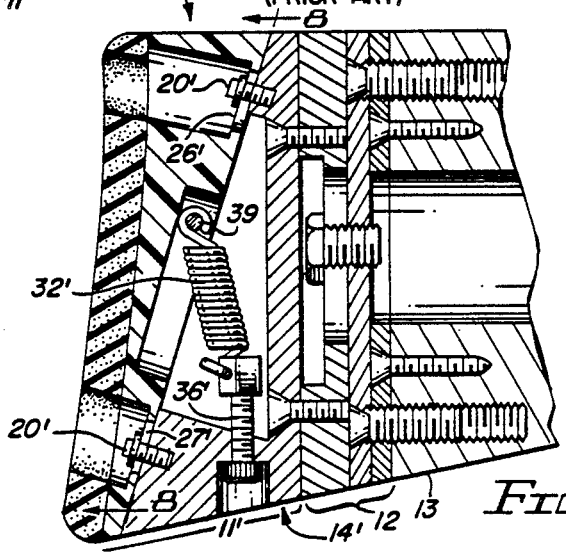
FIG. 5 is a cross-sectional view showing a variation of the recoil mechanism of FIGS. 2–4 and the adjustable mounting device of FIG. 1 as seen along line 5—5 of FIG. 1.

A suitable recoil mechanism 11 is shown in FIGS. 2–4 with more detail thereof shown in U.S. Pat. No. 4,316,342, the details of which are included herein by reference.

The free end of base plate 16 of recoil mechanism 11, which in this case is secured directly to butt 13 of the gun stock by means of one or more screws 17, is provided with a key or slide plate surface 18 from which protrudes the heads 19 of a pair of spacedly positioned bolts 20.

Mounted to form a slide plate surface along which the slide plate surface 18 may move thereover is the second member 15 of recoil mechanism 11. This second member 15 comprises a face plate 21 supporting a foam or resilient pad 22 which is formed along its surface 23 to fit the shoulder of a user. Pad 22 and face plate 21 are provided with openings 24 and 25 which open into suitable blind sockets or slots 26 and 27, respectively, in face plate 21. Bolts 20 are threaded into suitable apertures in base plate 16 with their heads 19 loosely fitting one over each of the openings into slots 26 and 27. The heads are of a diameter larger than the width of slots 26 and 27, thereby holding members 14 and 15 together in a relatively movable arrangement.

In order to move member 14 laterally of member 15 toward the feet of the gunner under recoil forces, two or more ball bearings 28 are arranged in two or more races 29, as shown in FIGS. 2, 3 and 4. Since pad 22 of the second member 15 of the recoil mechanism is held relatively fixed on the curvature of shoulder 30 of the user of the firearm, part 14 moves relative thereto on recoil with ball bearings 28 in their races 29 reducing the sliding friction of the moving parts.

Except during the effects of the forces of recoil, parts 14 and 15 are held in juxtapositioned relationship by any suitable biasing means such as, for example, the spring biasing means 31 shown in FIG. 2. In this figure, part 14 of recoil mechanism 11 is held juxtapositioned to part 15 by a coil spring 32 secured at one end 33 by a bolt 34 to face plate 21 of part 15 and at the other end 35 to a bolt 36 threadedly positioned in a suitable bore 37 in the base of part 14. Bore 37 is open ended so that a screwdriver or suitable tool (not shown) can be inserted into a slot 38 in the head of bolt 36 for relative adjustment of it in bore 37 to increase or decrease the tension on coil spring 32.

FIGS. 5–13 show a recoil mechanism 11′ that is substantially equivalent to mechanism 11 just described. Mechanism 11′ is secured to the butt end 13 of a gun stock by means of adjustable mounting device 12 of the invention. The following description is readily obvious from the illustration shown in FIG. 6.

Recoil mechanism 11′ comprises relatively movable members 14′ and 15′ slidably secured together by two bolts 20′ that pass loosely through in-line slots 26′ and 27′ of member 15′ and thread into apertures 76 in member 14′. A coil spring 32′ biases member 15′ in its rest position relative to member 14′.

Member 14′ comprises a wedge-shaped base plate 16′, coil spring 32′, a screw or bolt 36′ for holding the lower end of spring 32′ and a clip 41 that threads over the end of screw 36′ and serves as an anchor for the lower end of spring 32′. A longitudinal cavity 42 that opens at the rear of base plate 16′ houses spring 32′ and provides access to mounting holes 43 at the upper and lower ends of plate 16′. Screw 36′ passes upward through a clearance hole into the lower end of cavity 42, then threads into clip 41. Clip 41 is restrained against rotation by the walls of cavity 42 so that as screw 36′ is turned, clip 41 is threadably drawn thereupon and moved in a downward direction, thereby increasing the tension on spring 32′, the lower end of spring 32′ being secured within a hole 44 at one side of clip 41 and its upper end secured by means of a pin 45 inside a cavity 46 of member 15′.

Member 15′ is also wedge-shaped, its wider upper end being juxtapositioned opposite the narrow upper end of member 14′. Slots 26′ and 27′ lie at the bases of two cavities 47 and 48, respectively, which provide clearance for the heads of bolts 20′ by means of which member 15′ is slidably secured to member 14′. The rear or outside surface of member 15′ is covered by a resilient pad 22′. Member 15′ is molded from a plastic material having a smooth, substantially frictionless surface that slides easily over the mating surface of member 14′ so that the need for ball bearings such as those employed between members 14 and 15 of mechanism 11 is eliminated.

Adjustable mounting device 12 comprises three plates including a base plate 51, an inclined plate 52 and a slide plate 53. All three plates are oblong and shaped to conform with the perimeter of the end of the butt 13 of the gun stock.

Base plate 51 is a flat plate having a thickness of $\frac{1}{8}$ to $\frac{1}{2}$ of an inch. Four countersunk holes 54 are provided for securing plate 51 to the butt end of the firearm using four wood screws 55. Two threaded holes 56 and 57, approximately $\frac{3}{8}$ of an inch in diameter, are located near the upper and lower ends, respectively, of plate 51.

Inclined plate 52 is also a flat plate, $\frac{1}{8}$ to $\frac{1}{2}$ of an inch thick. Two countersunk holes 58 and 59, approximately $\frac{1}{8}$ of an inch in diameter and spaced apart a distance equal to the separation between holes 56 and 57 of plate 51 are located near the upper and lower ends, respectively, of plate 52. One or two threaded holes 61 and 62 are positioned between holes 58 and 59 along the longitudinal centerline of plate 52.

Slide plate 53 is $\frac{1}{4}$ to $\frac{1}{2}$ of an inch in thickness. A recessed area 63 extends laterally across the center of plate 53 and a slot 64 extends vertically inside area 63 along the longitudinal centerline of plate 53. Two threaded holes 65 are provided, one at either end of plate 53 outside recessed area 63. The spacing between the two holes 65 corresponds to the spacing between holes 43 of base plate 16' of member 14'.

The assembly of mechanism 11' and device 12 and their attachment to the butt 13 of a gun stock are most readily described with reference to FIG. 6.

Figure 12A:
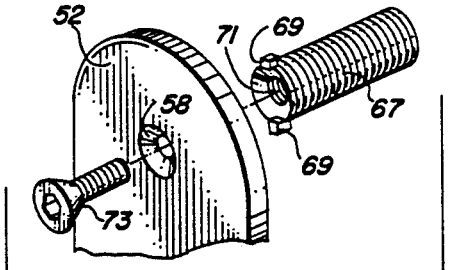
FIGS. 12A and 12B are enlarged partial perspective views showing details of a portion of the adjustable mounting device.
Figure 12B:
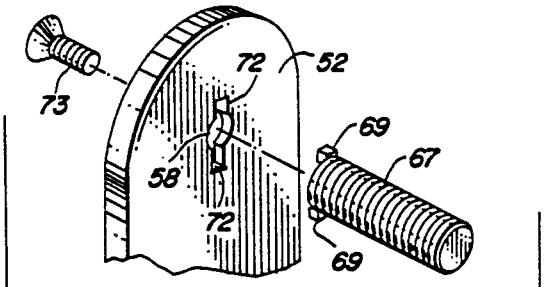

Plate 51 is first secured to butt 13 by means of the four screws 55 that are passed through holes 54 into mating holes 66 in butt 13. Two special threaded studs 67 are turned into holes 56, 57 and extend into aligned holes 68 in butt 13. Holes 68 may be clearance holes or they may be threaded to mate with studs 67. As shown in FIGS. 12A and 12B, studs 67 are specially formed with two retaining tabs 69 located at one end. The two tabs are located at the outer edge of the stud opposite each other and extend longitudinally therefrom. At this same end of stud 67, a threaded hole 71 is arranged to extend into the end of the stud along its longitudinal axis. Indentations 72 that mate with tabs 69 are provided at the peripheries of holes 58 and 59 on the face of plate 52 juxtapositioned to plate 51.

Following the installation of studs 67 into holes 56, 57 of plate 51, studs 67 are rotated to provide alignment of tabs 69 with indentations 72. Plate 52 is then positioned over the ends of studs 67 and is secured thereon by means of two screws 73 that mate with holes 71 of studs 67. Screws 73 have countersunk heads for flush mounting, and are turned into place by an allen wrench.

Plate 53 is slidably secured to plate 52 by means of a flat headed hex screw 74 that passes through slot 64 and threads into one of the holes 61 or 62 of plate 52. Hole 61 or 62 may be selected as an adjustment option.

Member 14' is next secured to plate 53 by passing two screws 75 through holes 43 and threading them into holes 65 of slotted plate 53.

Finally, with spring 32' already secured to members 14' and 15', member 15' is slidably secured to member 14' by installing screws or bolts 20' through slots 26' and 27' into holes 76 that are approximately positioned at the ends of base plate 16' on the side that faces member 15'.

Figure 7:
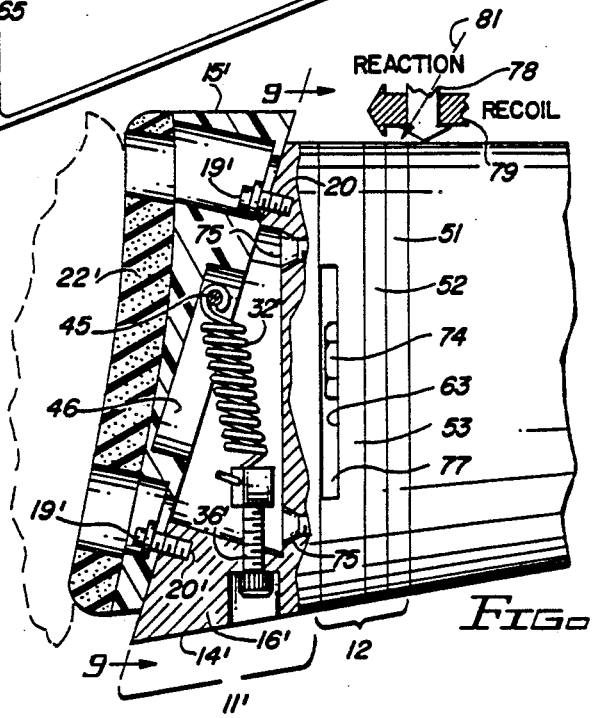
FIG. 7 is a partially cut away side view of the mechanism and adjustable mounting device of FIGS. 1, 5 and 6 showing a portion of the recoil and redirection mechanism momentarily displaced by the recoil and reaction forces produced by the firing of the gun.

In the completed assembly shown in FIG. 7, studs 67 have been threaded all the way into holes 56 of plate 51 so that plate 52 is positioned against plate 51. Plate 53 is also centered upon plate 52. The head of screw 74 is seen to be accessible by means of a flat wrench through a slot 77 that is formed by recessed area 63. By virtue of such access, screw 74 may be tightened or loosened, using a flat wrench during the adjustment of device 12.

FIG. 7 also illustrates the action of mechanism 11. When the rifle or shotgun is fired, reaction and recoil forces 78 and 79, respectively, are produced at the butt end of the gun stock. The resultant force 81 of the reaction and recoil forces drives member 14' downward relative to member 15' against the restraining force of spring 32'. Spring 32' softens the shock experienced by the person holding the firearm. Pad 22' also provides a cushioning action to prevent bruises and fatigue. Perhaps, more importantly, the firearm is now seen to be deflected angularly and directionally to a lesser degree by virtue of the altered motion that results from the action of mechanism 11'. Without the benefit of mechanism 11', the butt drives hard against the user's shoulder in an uncontrolled manner and the barrel rocks upward away from the target. With a properly adjusted mechanism 11' and with mechanism 11' properly mounted to the stock of the firearm by means of an optimally adjusted device 12, the directional deviation can be held to a minimum to permit a more accurate rapid firing rate.

The proper positioning of the mechanism 11 or 11' on the gun stock is important in terms of user comfort and also in the interest of minimizing firearm deflection. It is influenced by the user's anatomy in the region of the hollow of the shoulder, the length of the user's arms and also by the dimensions and proportions of the firearm and the location of its center of gravity. The device 12 affords four types or dimensions of adjustment to accommodate such variable requirements.

The first of the four adjustment dimensions controls the effective length of the gun stock. The effective length can be increased by backing out the studs 67 to increase the separation between plates 51 and 52 of mounting device 12.

A second adjustment controls the angle at which recoil mechanism 11 or 11' is secured relative to the gun stock. This adjustment is achieved as shown in FIG. 11 by allowing the upper stud 67' to extend a greater distance from plate 51 than lower stud 67'' with the result that plate 52 is inclined or canted with respect to plate 51. Mechanism 11 or 11' which is slidably secured to plate 52 is thus also tilted or canted with respect to the stock of the gun.

A third adjustment option permits a controlled vertical displacement of the recoil mechanism 11 or 11' with respect to the stock of the gun. This adjustment is illustrated in FIG. 10 where plate 53 is shown displaced upwardly relative to plate 52. To make this adjustment, screw 74 is loosened using a wrench that can be inserted into slot 77. The vertical slot 64 of plate 53 then permits plate 53 to be moved upward or downward relative to plate 52 until the desired position is achieved, after which screw 74 is again securely tightened.

A fourth adjustment allows axial rotation of the recoil mechanism 11 or 11' with respect to the stock of the gun. This adjustment is accomplished by loosening screw 74, rotating mechanism 11 or 11' about the axis of screw 74 and then tightening screw 74 when the desired angular relationship is achieved.

These four types of adjustments permit the individual user to optimize the fit and balance of the total structure, including the firearm and the recoil mechanism and involving as well, the user's own physical proportions for best performance and for comfort during use.

A simplified second embodiment of the adjustable mounting device of the invention is illustrated in FIGS. 13–15.

The simplified mounting device employs plates 52 and 53 of device 12, but does not include plate 51.

FIG. 13 shows the simplified device 80 employed for the mounting of recoil mechanism 11 or 11'. Here plate 52 is attached directly to butt 13 of the gun stock using wood screws 82. Plate 53, which is identical to plate 53 of device 12, is again slidably attached to plate 52 by means of screw 74 which passes through slot 64 of plate 53 and threads into one of the two holes 61 or 62 of plate 52. If screw 74 is appropriately dimensioned, it will not emerge beyond the far surface of plate 52, but if a longer screw is to be employed, a clearance bore 83 must be provided in the butt 13 of the gun stock. (A clearance bore 83 and a corresponding opening 84 in plate 51 for the same purpose is also shown in FIG. 11 as a minor variation of device 12.) The simplified device 80 allows the vertical displacement adjustment in which the position of the recoil mechanism is moved upward or downward with respect to the gun stock; it also permits rotation of the recoil mechanism about the axis of screw 74. It does not, however, permit the recoil mechanism to be tilted or canted relative to the gun stock, and it does not afford an adjustment in the effective length of the gun stock.

FIGS. 14 and 15 illustrate the use of a simplified device 80 for mounting a simple resilient pad 85 to butt 13 of a gun.

The simplicity of device 80 is most apparent in FIG. 15 where it is seen to comprise just the two plates 51 and 52, hex screw 74 and mounting screws 82. Two additional mounting screws 86 are required to secure the recoil mechanism 11 or 11' or pad 85 to device 80.

Arrow 87 shown in FIG. 15 illustrates the rotational adjustment described earlier whereby the rotational orientation of the recoil mechanism or shock absorbing pad may be altered relative to the stock of the firearm.

Figure 6:
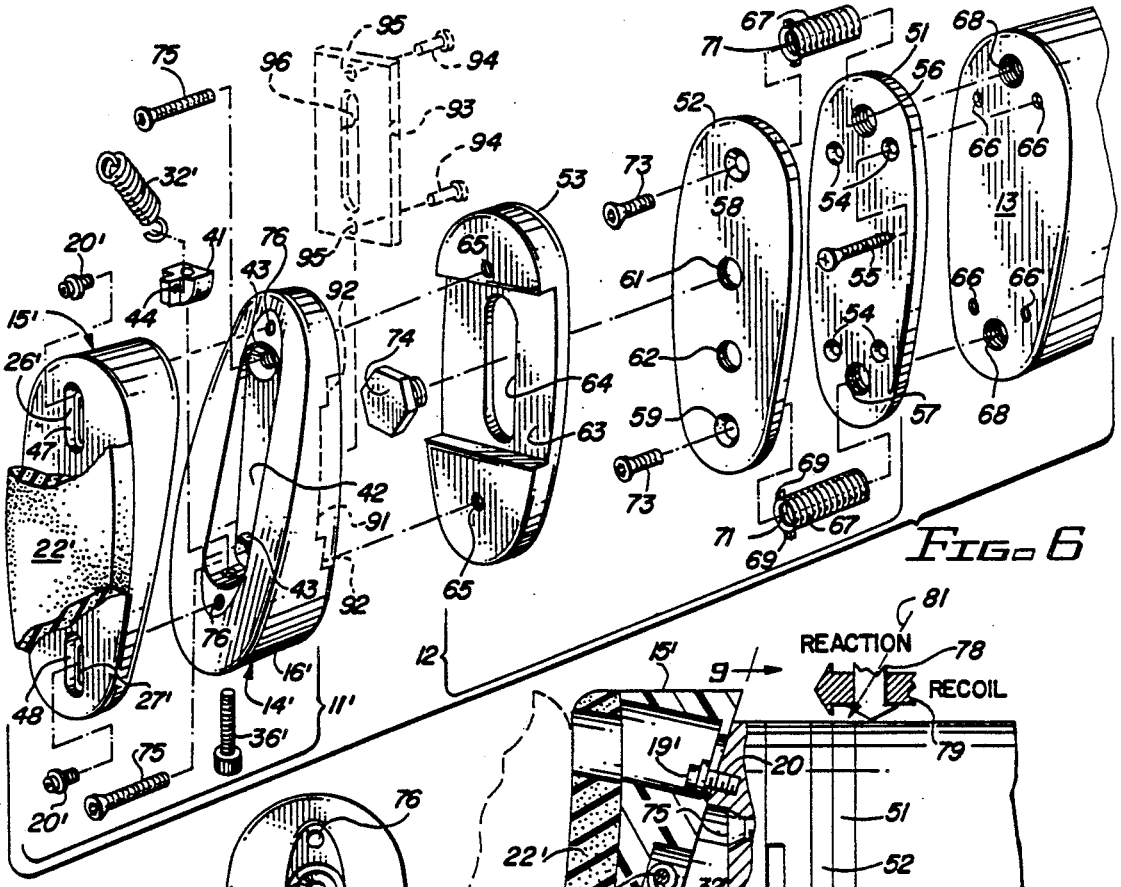
FIG. 6 is an exploded perspective view of the mechanism and adjustable mounting device of FIGS. 1 and 5.
Figure 9:
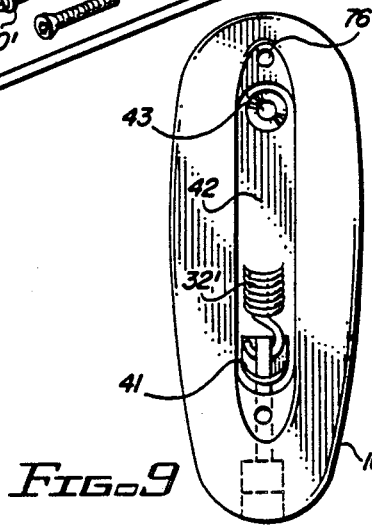
FIG. 9 is a cross-sectional view taken along line 9—9 of FIG. 7.

A simplified structure that retains the total functionality of recoil mechanism 11' and adjustable mounting device 12, as shown in FIG. 6, can be realized by incorporating a part of the adjustable mounting functionality into base plate 16'. The modifications required to achieve this variation of the invention are shown in broken lines in FIG. 6.

The first modification is the provision of a stepped recession 91 in the face of base plate 16' that faces device 12. Recession 91 comprises a first relatively deep lateral or transverse channel centered on a second wider but relatively shallow transverse channel, the second channel forming intermediate steps or shoulders 92 at the upper and lower ends of recession 91.

The second modification is the substitution of a simple slotted flat plate 93 for slide plate 53. Plate 93 is dimensional to fit inside the shallow channel of recession 91, its upper and lower ends resting upon the steps 92 where it is secured in place by means of screws 94 that pass through holes 95 provided at the ends of plate 93. The vertical slot 96 in the center of plate 93 is identical with slot 64 of member 53.

Prior to the installation of plate 93 over recession 91, screw 74 is installed in slot 96, its threaded end projecting toward plate 52. Access to the head of screw 74 is provided by the deeper portion of recession 91.

Because base plate 16 may be inexpensively molded in plastic, the addition of recession 91 adds little or no cost to this part, and the substitution of the simple flat plate 93 for the more complex and expensive slide plate 53 reduces the total cost of the assembly.

An effective and inexpensive adjustable mounting device is thus provided for securing a recoil mechanism or shock absorbing pad to the butt of a gun stock. The mounting device in combination with the prior art recoil mechanism or in combination with the resilient pad comprises an improved adjustable recoil mechanism in accordance with the stated objects of the invention, and although but a few embodiments of the invention have been illustrated and described, it will be apparent to those skilled in the art that various changes and modifications may be made therein without departing from the spirit of the invention or from the scope of the appended claims.

What is claimed is:

1. An adjustable recoil absorber for a shoulder held gun stock comprising:

a flat plate arranged to be rigidly affixed to the rear end of a gun stock, a first member juxtapositioned to said plate, a first means for attaching said first member to said plate, said first means being adjustable to angularly fixedly position at an incline a surface of said first means relative to a surface of said plate along the longitudinal axis of the gun stock, a second member attached to said first member and adapted for supporting the gun stock against the shoulder of a user, said first and second members being slidably movable laterally of each other, a second means for adjustably interconnecting said first and second members at one of a number of positions relative to each other, said second member is provided with a recessed area of a given depth extending laterally across its center and a slot extending longitudinally of said second member within said recessed area, and said second means comprises a bolt extending from said recessed area through said slot and into threaded engagement with said first member for angularly rotating said second member relative to said first member about a common axis, said bolt having a head larger than the width of said slot but of a thickness less than the depth of said recessed area for engagement by a wrench laterally of the length of said second member.

* * * * *